United States Patent [19]

Hsu

[11] Patent Number: 4,830,254

[45] Date of Patent: May 16, 1989

[54] TWO-STAGE POWER DRIVING SYSTEM FOR POWDER ACTUATED TOOLS

[76] Inventor: Yung-Shing Hsu, P.O. Box 3536 U.P.B., University Postal Branch, Las Cruces, N. Mex. 88003

[21] Appl. No.: 149,378

[22] Filed: Jan. 28, 1988

[51] Int. Cl.[4] ..... B25C 1/14

[52] U.S. Cl. ..... 227/10; 227/156

[58] Field of Search ..... 227/9, 10, 11, 156

[56] References Cited

U.S. PATENT DOCUMENTS

| | | | |
|---|---|---|---|
| 3,395,843 | 8/1968 | Kvavle | 227/10 |
| 3,559,272 | 2/1971 | Hsu | 29/432 |
| 3,658,229 | 4/1972 | Pomeroy | 227/10 |
| 3,690,536 | 9/1972 | Bakoledis | 227/10 |

*Primary Examiner*—Paul A. Bell

*Attorney, Agent, or Firm*—Robert L. Harrington

[57] ABSTRACT

A power amplifier for a low velocity piston driven powder actuated tool. The power amplifier accommodating a stacked arrangement of a pin or stud and a second stage power load including a power pill. Such power amplifier in one form is provided as a replacement for the lower tool end piece. The power amplifier is sufficiently strong to withstand ignition of the power pill. The lower end of the piston that is driven through the tool, in accordance with the invention, is provided with a shearing tip. A first stage power load is ignited to drive the piston. The piston propels the shearing tip against the power pill to ignite the power pill and in concert with the force of the piston, drives the pin into the work piece with the relayed forces rivalling that of a high velocity powder actuated tool. Also included is the feature for exhausting the power load generated gases from the barrel upon recoil of the piston.

9 Claims, 3 Drawing Sheets

TWO-STAGE POWER DRIVING SYSTEM FOR POWDER ACTUATED TOOLS

FIELD OF INVENTION

This invention relates to a power amplifier for piston tools used to power drive pins and studs, and more particularly to a provision to the design of the conventional light-weight low velocity piston pin driving tool that enable such tools to substantially increase driving capability.

BACKGROUND OF THE INVENTION

Explosive actuated tools (powder actuated tools) for driving pins and studs have been available for many years. One type of such tool has a rod, referred to as a piston, that slides up and down inside a barrel. On end of the barrel is referred to as the breach end and is fitted with a power load firing chamber and trigger mechanism. The other end is fitted with a lower end piece which receives and holds a pin or stud to be driven. A power load in the firing chamber is ignited to drive the piston down the barrel and against the pin head and into a work piece. Such a tool is more specifically described in U.S. Pat. No. 3,239,121, issued on Mar. 8, 1962, to Kopf et al.

A second type of tool is designed for achieving relatively higher driving capability, for example to drive ⅜" threaded studs or ⅜" headed pins into concrete and steel. In these tools, the pin is placed at the breach end of the barrel adjacent to the firing chamber and the ignition of the power load propels the pin down the barrel in free flight to impact the work piece as it emerges from the barrel end. A disclosure of this latter type of tool appears in U.S. Pat. No. 3,221,966, issued on Dec. 7, 1965, to Kopf et al.

The former tool is referred to as a low velocity piston tool (Lo V Tool) and the latter tool is referred to as a high velocity tool (Hi V Tool). The Lo V tool is considered much safter to operate because the pin or stud is never in free flight. However, it also typically generates a driving power that is far lower and has been used only for light and medium duty applications, e.g. fastening dry wall and window track to concrete or wood framing to concrete. Attempts to develop tools of the Lo V design with greater driving capability has, in the past, involved use of higher level power loads in order to drive the heavier piston. The firing chamber and thus the entire tool had to be massive in order to withstand the higher forces and recoil. The increased mass makes the tool unwieldy and undesirable for use as compared to the Hi V tool even though safety is compromised.

It is an objective of the present invention to provide the Lo V piston tool, in its current light weight design, with the driving capability of the Hi V tool without sacrificing safety and other light-weight advantages.

BRIEF DESCRIPTION OF THE INVENTION

The present inventin solves the need of increasing driving power of Lo V piston tools by a two-stage power driving system. The light duty Lo V piston tool design is used as a basic tool design wherein a low-to-moderate power load propels a piston down the tool barrel. It is relayed with a second stage solid propellant power load positioned on the pin head. The piston provides driving power to drive the pin in part and also ignites the second stage power load which functions like a relay booster. The joint powers of the piston and direct applied second stage power load drives the pin to achieve a substantially greater penetration of the pin than was previously thought possible for a light-weight Lo V piston tool.

The advantages of this two-stage power driving system are very significant. The basic tool is a light-weight, light-duty tool design. The heavy duty driving operation is achieved by a booster chamber provided at the tool's lower end. Prior lightweight tools with small bores (less than ⅜") will not accommodate the larger pins and studs that typically require the higher driving capability. Also, the lower tool end, not being designed as a firing chamber, may not be sufficient in strength to withstand even the reduced power load of a driving cap such as contemplated herein. Regardless, these changes to the basic design are readily achieved and the resultant driving capability rivals that of a heavy duty or Hi V tool. The tool retains its light weight and low recoil and, whereas the pin is never placed in free flight, it is substantially safer to operate.

The invention and its numerous other advantages will be more apparent upon reference to the following detailed description and the accompanying drawings briefly explained as follows.

Figure 1:
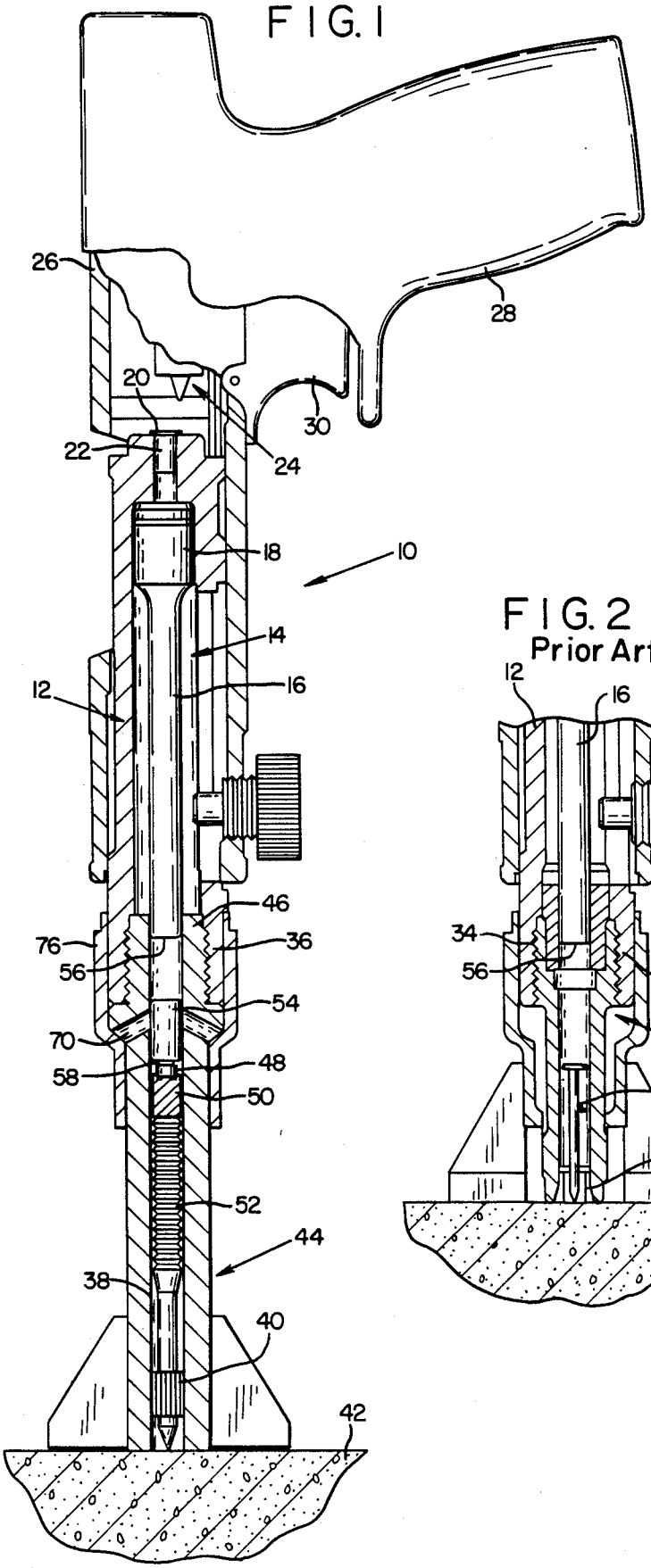
FIG. 1 is a side view, with portions broken away, of a Lo V tool design incorporating the features of the present invention.

FIGS. 5*a*, 5*b*, 5*c* and 5*d* illustrate the stages of operation of the tool of FIG. 1.

Figure 3:
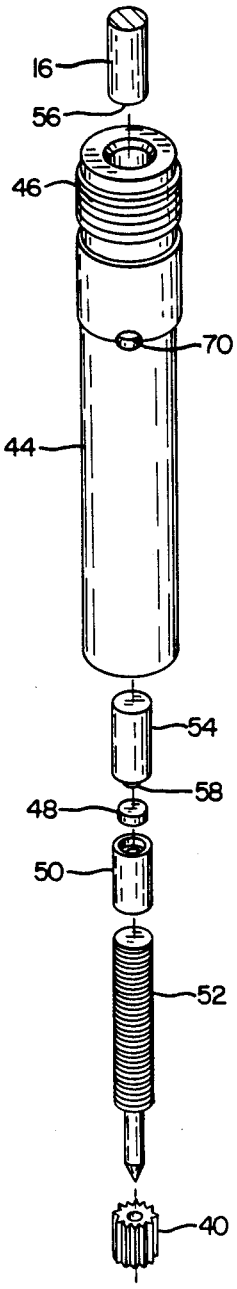
FIG. 3 is an exploded view, in perspective, of the components of the power amplifier features in the FIG. 1 version of the present invention.
Figure 2:
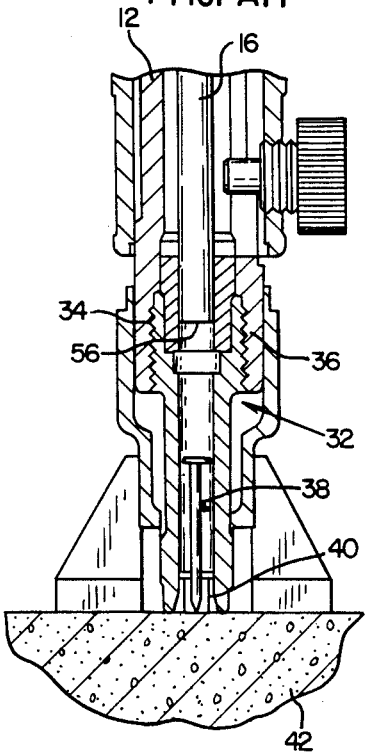
FIG. 2 Prior Art
FIG. 2 is a side view, in section, of a lower tool end that is replaced by the improved features of the present invention.

Reference is made to FIGS. 1, 2 and 3. A Lo V powder actauted tool 10 is illustrated in FIG. 1 which is generally of conventional design except for that portion referred to as the tool's bottom end piece, a conventional design for prior Lo V end pieces being illustrated in FIG. 2. From FIG. 1, the tool includes a barrel 12 having a cylindrical opening 14. A piston or rod 16 consists of a thin cylindrical rod with an enlarged head portion 18. The piston 16 slides in the barrel 12 as permitted by opening 14. A power load seat 20 is provided in the rear end of the barrel 12 to receive a power load 22. A firing pin 24 projects through an orifice in the breach to detonate the power load 22 and propel the piston down the barrel. A housing 26 surrounding the barrel 12 includes a handle 28 with a trigger 30 that actuates the firing pin.

Many details of the tool are omitted as they are unnecessary for an understanding of the present invention. If is sufficient to understand that typically in prior tools as illustrated in FIG. 2, the tool further includes a tool bottom end piece 32 with the threaded portion 34 thereof screwed into the threaded portion 36 of the barrel 12. The rod 16 is slide-fit to the bore 38 through the end piece. A pin is placed in the open end as illustrated and is held in place by a plastic collar 40 that resiliently grips the wall of the bore 38. The head of the pin which also is slide-fit to the bore 38, in combination with the collar 40, maintains the pin aligned in the barrel end piece. Upon detonating the power load, the piston 16 is driven down the bore 38 and strikes the pin head to drive the pin into the work surface 42.

The lower tool end is typically a separate piece from the barrel 12 primarily because damage to the tool invariably occurs at the lower or exit end of the barrel. This replaceable end piece allows for rapid and inexpensive repair to the tool. Because almost all (if not all) Lo V tools incorporate this concept of a replaceable lower end piece, adapting prior tools to incorporate the power amplifier of the present invention is readily achieved. The conventional lower end piece is simply removed and a power amplifier of the present invention is screwed into the tool in its place.

The modified lower end portion referred to hereafter as a power amplifier is illustrated in FIGS. 1 and 3. An elongated barrel end replacement (power amplifier) 44 is provided with screw threads 46 that mate with screw threads 36 of barrel 12. The power amplifier 44 is of substantial strength (e.g. with a wall thickness of at least ⅜" thick) to withstand a moderate explosion of a second stage power load.

With the above changes, the tool is ready to produce amplification of the tool's driving power. The added strength of the barrel end extension 44 is an important factor, but also is the need to provide an extended barrel length and bore diameter that will accommodate the larger pins and studs that require the increased power driving capability, e.g. ⅜" threaded studs or ⅜" headed pins.

A key factor in the amplification concept is the provision of the second stage of propulsion as provided by power load 48. Power load 48 as contemplated for the preferred embodiment is a propellant material referred to as a power pill. Several advantages are achieved by this power pill. As compared to a convention power load (a blank cartridge), the power pill ignites less rapidly and tends to propel the pin rather than explosively drive it. The power pill has no primer and therefore requires a substantial impact for ignition, i.e. the impact of the explosively driven piston 16. Thus handling and use of the tool is significantly more safe than use of a conventional power load.

The concept of a power pill as a pin driving power load was disclosed in U.S. Pat. No. 3,559,272 issued to the inventor of the present invention. However, that disclosure taught the utilization of the power pill as a single stage power load, ignited manually. It did not teach the use of a two-stage power driving concept as contemplated herein. It also did not teach the concept of gas exhaustion to reduce or eliminate recoil when using power loads sufficient to drive the larger pins. The exhaustion feature as applicable even to the tools of U.S. Pat. No. 3,559,272 will be explained later.

The power pill contemplated for this invention is that which was described in the above patent as follows:

> "The power pill [48]is selected to have the properties of high energy output preferably in the range of about 40 to 300 foot/pounds. The preferred propellant material is one that can be contained in a small volume, will ignite by high impulse, e.g. one pound second, and is sufficiently stable so as not to be ignited at a lower impulse or by friction such as might be encountered in mishandling of the pins or loaded tool. Also these conditions should remain constant for a substantial shelf life period. A suitable propellant for the power pill is composed of compacted nitrocellulose fibres having a density of about 1 gram per cubic centimeter." (Column 3, lines 33–44)

From the prior disclosure also comes the concept of the power pill cushion 50 which further inhibits accidental firing, provides a sealant against the escape of the gasses generated by firing, and by doing so reduces noise level while increasing the beneficial effect of the expanding gasses driving the pin.

The threaded stud 52 to be driven into work surface 42 can take a variety of forms. The stud shown has a threaded shank portion of, e.g. ⅜" diameter which when driven into a concrete substrate (or steel) exposes the threaded shank (which then is a means for fastening studs and the like to the substrate). The stud is aligned in the bore of the power amplifier in the same manner as for the smaller pins; i.e. with a resilient plastic collar 40 surrounding the pointed end of the pin and the threaded shank and piston end slide-fit to the bore 38.

A further significant component of the embodiment of the present invention of FIG. 1 is the provision of a piston extension 54. The piston of the typical Lo V tool has a flat or counter bored end 56. Such a flat or counter bored end will strike the head end of a pin squarely for correct driving in a conventional tool driving mode and cause a minimum of damage to the pin head. However, as explained in U.S. Pat. No. 3,559,272, the power pill is preferably ignited by a shearing action. Thus the piston extension 54 is provided with a shearing tip 58 which when plunged into the power pill or cap 48 generates the desired shearing action and thus ignition.

Figure 4:
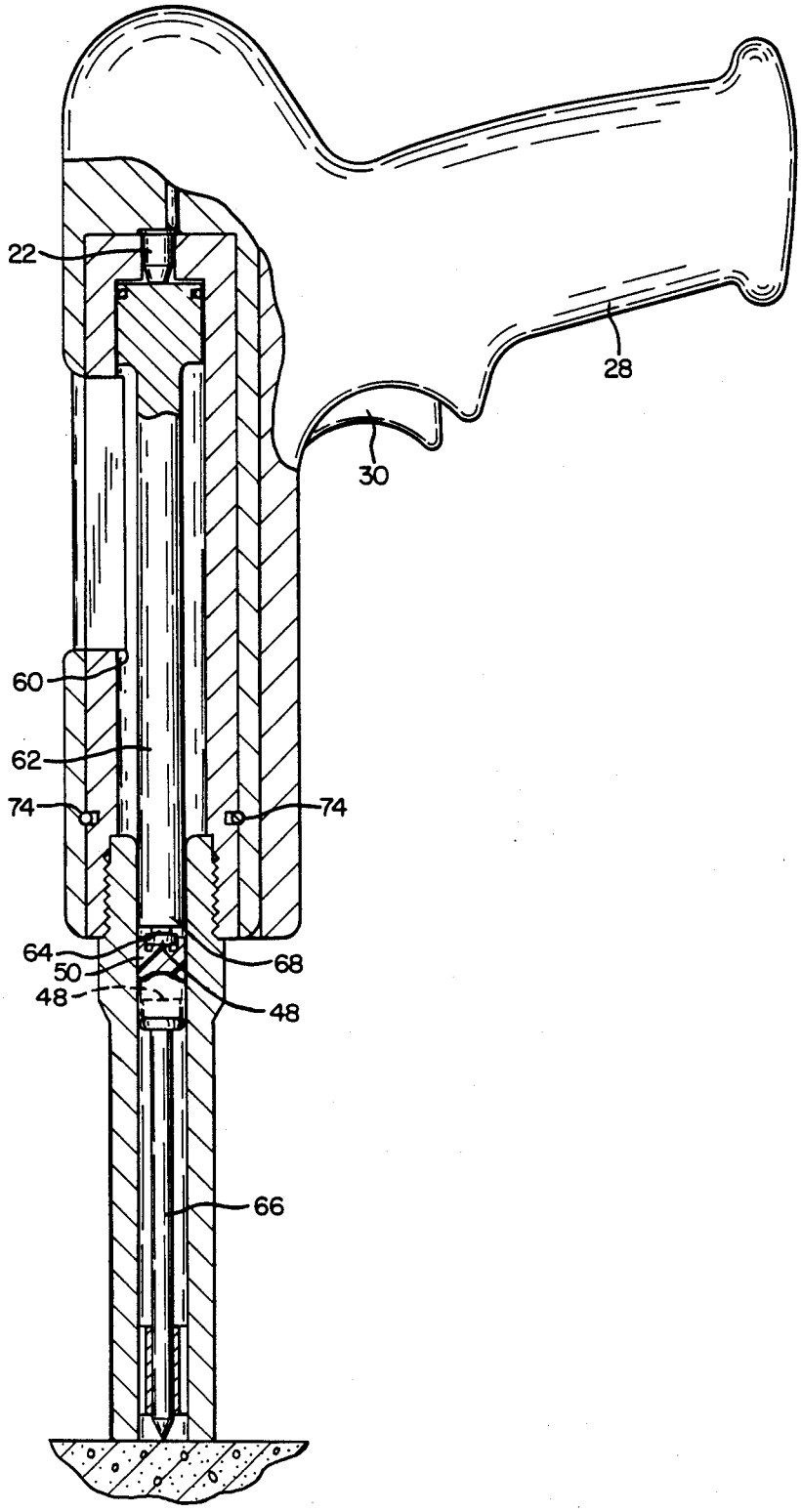
FIG. 4 illustrates a variation of the tool of FIG. 1.

FIG. 4 is provided to illustrate several modifications that are available. The tool is of a different but similar design. A cylindrical opening 60 for the piston 62 is provided in the barrel. The barrel is held in the tool housing by retaining rings 74. The piston is prevented from being driven out of the barrel by the reduced opening of the lower tool end piece (either of the original design or as illustrated for the amplifier). In most other respects the tool is similar to that of FIG. 1 wherein a trigger 30 in handle portion 28 triggers a firing pin. The firing pin projects against a power load 22 for driving the piston 62. The piston itself is modified or replaced for the tool of this embodiment of the invention as compared to conventional tools. In one respect it is different to the extent that a shearing tip 64 is formed directly on the end 68 of the piston, thus eliminating the need for the separate piston extender 54 of FIG. 1.

A headed in 66 rather than a threaded stud is illustrated. It will be noted that pin 66 is of substantially greater size than that illustrated in FIG. 2. Also illustrated in dash lines, the second stage power load or power pill 48 may be applied directly against the pin head, i.e. without the cushion 50. Also, rather than a stacked arrangement of the piston, second stage power load and pin, it may be desirable to provide a short gap for free travel of the piston 62.

Exhaust Portal

Reference is now again made to the embodiment illustrated in FIGS. 1 and 3. Provided in the barrel end extension 44 is an exhaust portal (or portals) 70, the function of which is to reduce or eliminate recoil. Thus, as will be explained in the operations section, when further expansion of gas generated in the second stage of propulsion is prevented by the pin or stud having been stopped from further penetration, the piston is pushed backward until the portals are opened. The trapped gas is exhausted through the portals within the shield 76 surrounding that portion of the barrel.

It is important to appreciate that the portal 70 is located in the barrel at a position that is rearward or upward as viewed in FIG. 1, relative to the point of ignition of the power pill 48. It is also forward of the piston end when the piston is in a fully retracted position.

Whereas the function of the exhaust portal is explained in the Operations section, the reader needs to appreciate that the exhaust portal does not come into play until forward or downward movement of the piston is completed with the piston forced back by the expanded gas and the pin or stud having been bottomed out. This term is used to indicate the termination of further penetration by the pin for whatever reason including the existence of a hard material embedded in substrate 42, i.e. a material that cannot be penetrated by the power driven pin. Particularly in this latter event, the compressed gases can generate a substantial recoil and the exhaust portal 70 is an important feature in that event.

More importantly, this same recoil retardant or avoidance feature is applicable to the single stage tool of U.S. Pat. No. 3,559,272. In that tool, if the power load, pin and substrate hardness are not properly matched, recoil can occur in this single stage tool as well. Thus locating an exhaust portal just above or rearwardly of the point of power pill ignition will function in the same manner with the same benefits as described herein for the power amplifier. Accordingly, this exhaust portal feature is independently covered in the calims appended hereto and has application to the tool of U.S. Pat. No. 3,559,272 and other tools wherein recoil due to unspent gasses between the pin or stud and piston is a factor.

Pad Ejection

Another feature is the indentation in the face of the pad 50 that fits over the shank of stud 52 or the head of pin 66. By fitting the pad indentation to the head or shank configuration, upon compressive driving of the pad against the pin or stud, the pad will grip the stud or pin head and will be ejected from the bore of the tool with ejection of the pin or stud from the work surface 42. It is, of course, important to remove this spent pad from the bore before a new power load and pin or stud is placed in the barrel end and this feature is important for that reason.

OPERATION OF THE PREFERRED EMBODIMENT

With reference to FIGS. 1 and 3, a power amplifying kit may be provided consisting of the lower tool end replacement 44, piston extension 54, and a quantity of power pills and cushions 48, 50. The lower tool end 32 (FIG. 2) is simply unscrewed and the new tool end 44 screwed into the end of barrel 12. The extension 54 with tip 58 pointed at the barrel end exit is inserted, then the power cap and cushion 48, 50, and then the drive pin 52.

A conventional power load 22 is loaded into power load seat 20 and the tool is ready for firing. The tool end is placed against the work surface as illustrated in FIG. 1. The trigger 30 is pulled and the power load 22 ignited. The resultant driving force of the piston 16 is thereby impacted on the piston extension 54. The tip 58 crushes the secondary power pill 48 to ignite it and thereby enhance the driving power imparted to the pin.

It should be noted that the resistive force of the work surface 42 must be substantial or the pill 48 will not be ignited. Thus if the pin happens to be placed at a weakened section of the work surface 42 (e.g. containing a void), the pin and non-ignited power load will simply be driven into the void and the additional power of the power pill will remain dormant.

Figure 5A:
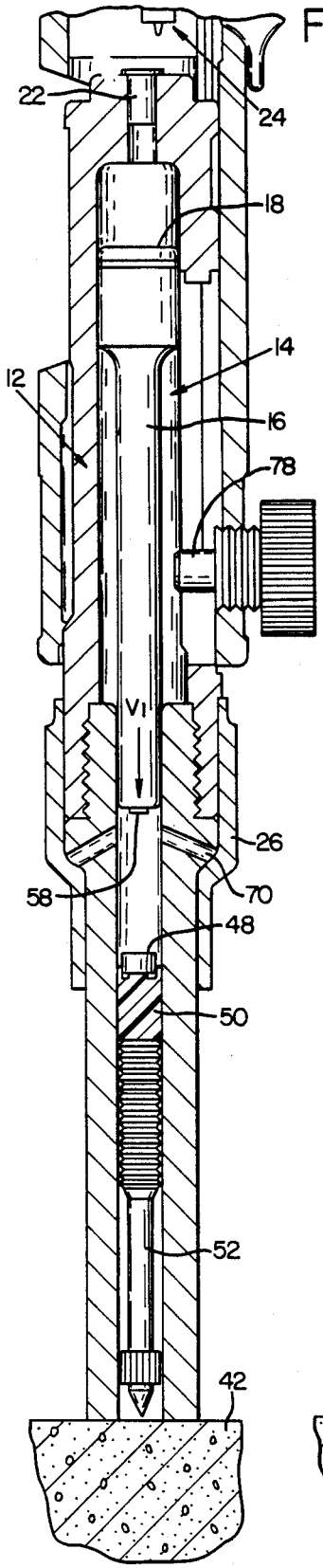
Figure 5B:
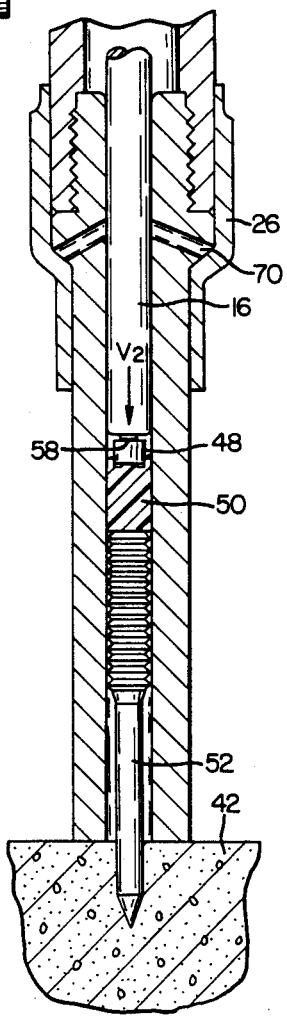

FIGS. 5*a*–5*d* illustrate the operation of the tool in detail. Reference $V_1$ of FIG. 5*a* indicates the propulsion of the piston in the first stage, i.e. upon ignition of power load 22. FIG. 5*b* and reference $V_2$ illustrates the point at which the propelled piston 16 is performing the dual functions of initiating a driving of the stud into work surface 42, and shearing of the power load 48. (Note that the piston has by-passed portal 70.)

Figure 5C:
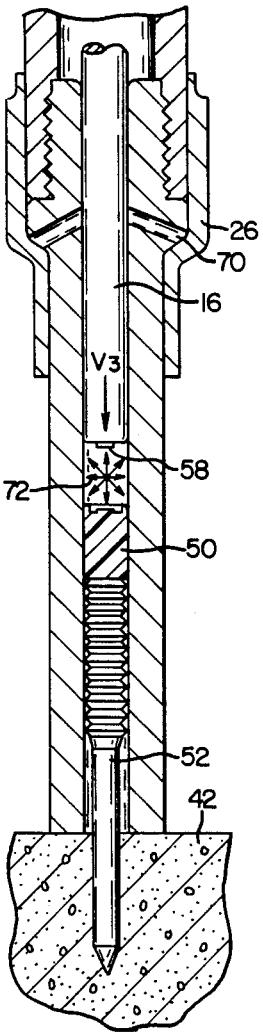

FIG. 5*c* and reference $V_3$ indicate the take-over of the second stage of propulsion. In this stage, the downward propulsion of the piston 16 resists recoil as generated by gas expansion due to the rapid burning of power load 48.

Figure 5D:
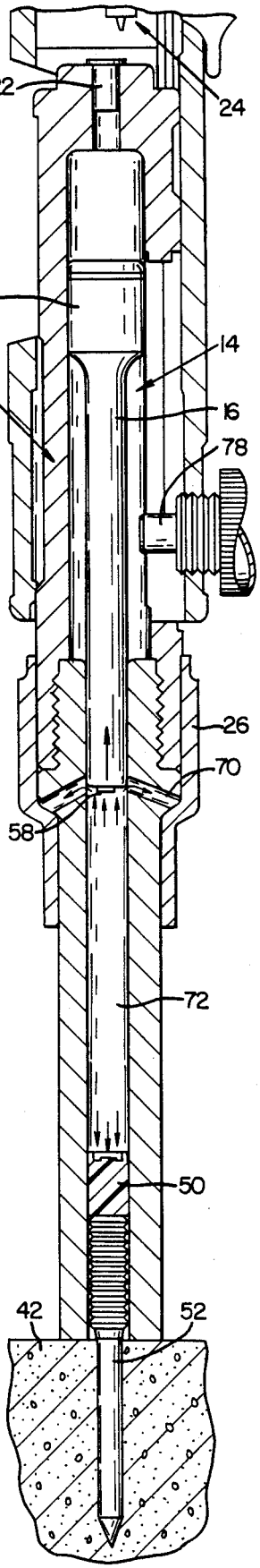

FIG. 5*d* illustrates the recoil mode, i.e. with the piston 16 recoiling due to the expansion of the gasses 72. The piston 16 withdraws to the point where the gas can exhaust out the portals 70 to be muffled (in part) by the surrounding shield 76. Full seating of the piston is accomplished in the conventional manner of pulling the barrel to its full extension with seating lug 78 functioning to force the piston to its fully retracted position in the barrel.

Numerous other modifications will become apparent to those skilled in the art upon learning of the concept of utilizing a second stage power load, e.g. a power pill, to enhance the driving capability of a conventional Lo V piston tool. Included are hand-held tools whereby ignition of a power load is generated by striking a firing pin device with a hammer head, thus eliminating the complexity of the trigger mechanism. These and numerous other modifications are encompassed by the invention as indicated by the scope of the claims appended hereto.

I claim:

1. In a powder actuated tool comprising a barrel, a piston and a first stage power load activation means for exploding the primary power load for driving the piston through the barrel toward a work piece, and the improvement that comprises;

a power amplifier including a barrel lower end piece, a penetration member, and a second stage power load having the property of being primer-less and ignited only by a shearing force, said second stage power load seated on the penetration member, and a shearing element positioned between the piston and second stage power load to be impacted by the piston and in turn impacting and shearing the second stage power load for igniting said power load and providing a second stage driving of the penetration member into the work piece.

2. In a powder actuated tool as defined in claim 1 wherein said second stage power load is a power pill of a propellant material ignited by high impulse.

3. In a powder actuated tool as defined in claim 2 wherein said second stage power load is composed of compacted nitrocellulose fibers.

4. In a powder actuated tool as defined in claim 2 wherein said second stage power load shearing element is a shearing tip carried by the piston.

5. In a powder actuated tool as defined in claim 2 wherein said second stage power load shearing element is a piston extension provided between the piston and the power pill, said portion having a protruded shearing tip.

6. In a powder actuated tool as defined in claim 1 wherein an exhaust portal is provided in the power amplifier between the points of full retraction of the shearing element and the point of ignition of the second stage power load whereby recoil of the piston and shearing member exposes the portal for exhaustion of the recoil inducing gases.

7. A process for amplifying the driving power of a low velocity powder actuated tool having a barrel, a piston, and a first stage power load activating means for driving the piston through the barrel, and a lower tool end attached to the barrel, said process including;

providing a lower tool end replacement in the form of a power amplifier adapted for receiving a power pill and penetration member, and further adapted to withstand the firing of the power pill, providing a power pill ignition means to be activated by impact of the piston, and providing the combination of power pill ignistion means, power pill and penetration member in stacked arrangement in the power amplifier for ejection of the penetration member out of the power amplifier, and activating the first stage power load activating means for driving the piston to impact and actuate the power pill ignition means, whereby the sequence of propulsion forces drives the penetration member into a work surface.

8. In a powder actuated tool comprising: a barrel; a piston; a penetration member; and a power load, said power load being positioned within said barrel between said piston and said penetration member; means to hold said power load near the portion of said penetration member which is closest to said piston; a shearing element, said element being postioned between said piston and said power load in order to provide a shearing force to said power load so as to ignite same; and means for driving said piston down said barrel and in turn driving the shearing element down said barrel so as to ignite by impact said power load; said piston defining a fully retracted position within said barrel and defining an impact position within said barrel; and an exhaust portal positioned in said barrel intermediate the fully retracted and impact positions of said piston; whereby, when said piston is in recoil due to the expanding gases generated by the ignition of said power load, said exhaust portal allows the expanding gases to escape said barrel before said piston can reach its fully retracted position.

9. A process for power driving penetration members from a tool into a substrate and preventing recoil damage to the tool, which process comprises; providing a tool having a barrel, a piston slidable in the barrel, said barrel defining a fully retracted position for said piston, and means for driving the piston through the barrel toward the substrate, placing a stacked arrangement of a penetration member, an impulse igniting primer-less power load, and a shearing member in the barrel between the substrate and the piston, driving the piston from said fuly retracted position through the barrel and against the power load to impluse ignite the power load and generating thereby rapidly expanding gas to drive the penetration member into the substrate, allowing said piston to move in recoil action back up the barrel toward said fully retracted position, and further providing exhaust means in said barrel to exhaust the expanded gas during recoil action of the piston, said exhaust means being placed in said barrel at a position which will allow the expanded gas to exhaust from the barrel before the piston can reach the fully retracted position.

* * * * *